United States Patent [19]

Namitokov et al.

[11] 4,150,354

[45] Apr. 17, 1979

[54] CIRCUIT PROTECTION FUSE

[76] Inventors: Kemal K. Namitokov, prospekt 50-letia VLKSM, 44, kv. 18; Andrei A. Kharisov, ulitsa Tankopia, 8-b, kv. 41; Ivan V. Matsa, pereulok I. Karkacha, 27, kv. 15; Oleg M. Tochilin, ulitsa Chernyshevskogo, 1, kv. 17; Alexandr N. Bulgakov, prospekt Moskovsky, 96, kv. 78, all of Kharkov, U.S.S.R.

[21] Appl. No.: 799,657

[22] Filed: May 23, 1977

[51] Int. Cl.[2] ..... H01H 85/04

[52] U.S. Cl. ..... 337/290; 337/295

[58] Field of Search ..... 337/276, 290, 292, 295, 337/158, 159

[56] References Cited

U.S. PATENT DOCUMENTS

| | | | |
|---|---|---|---|
| 1,084,706 | 1/1914 | Murray | 337/290 |
| 3,849,755 | 11/1974 | Blewitt et al. | 337/290 |

FOREIGN PATENT DOCUMENTS

| | | | |
|---|---|---|---|
| 59310 | 3/1891 | Fed. Rep. of Germany | 337/159 |
| 45089 | 3/1960 | Poland | 337/290 |

*Primary Examiner*—George Harris

*Attorney, Agent, or Firm*—Lackenbach, Lilling & Siegel

[57] ABSTRACT

The fuse for the protection of electric circuits comprises a casing filled with quartz sand, terminal contacts and a fuse link made of aluminium or an aluminium alloy. The ratio of the mass of the quartz sand to the mass of the aluminium material of the fuse link is at least 40:1. The fuse link is made of strip metal conductors, the widest current-conducting section of each strip having a width-to-thickness ratio within the range of 2:1 to 100:1.

23 Claims, 29 Drawing Figures

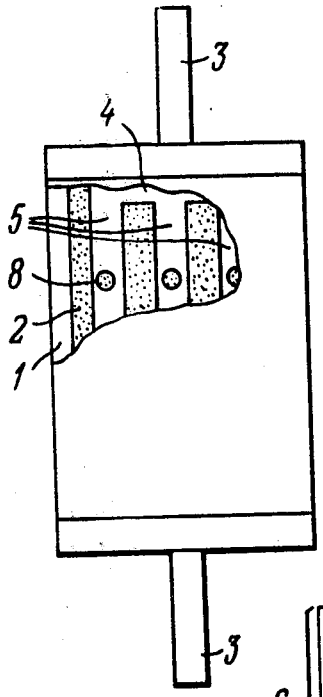
FIG.1
FIG.2
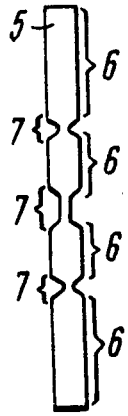
FIG.10
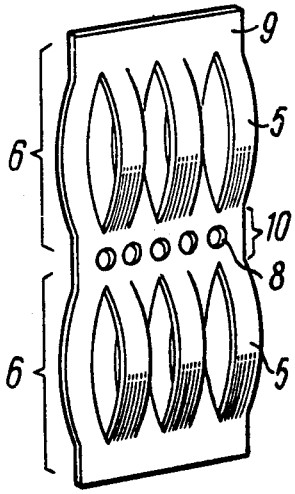
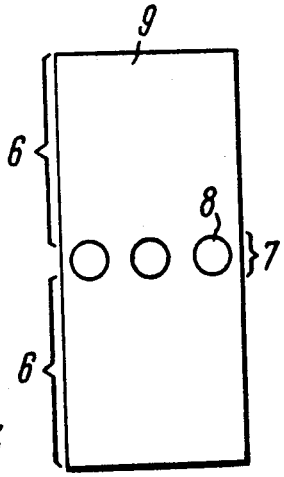
FIG.3

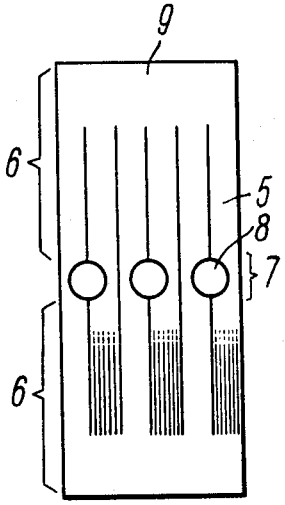
FIG 4
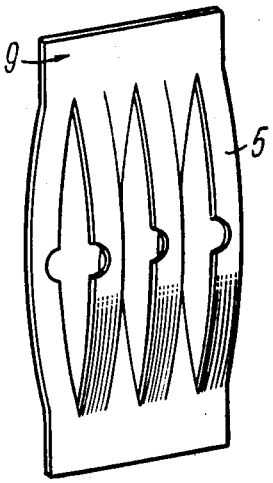
FIG. 5
FIG. 13
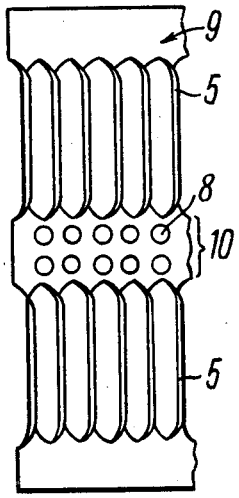
FIG. 14
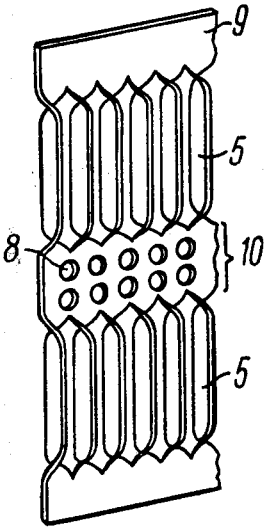

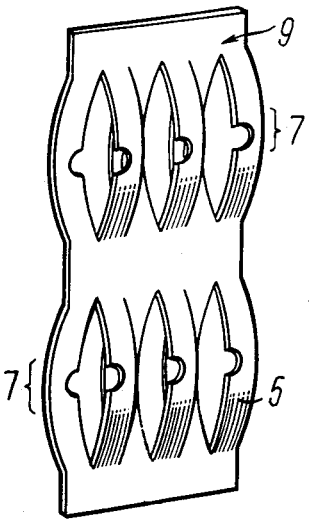
FIG. 6
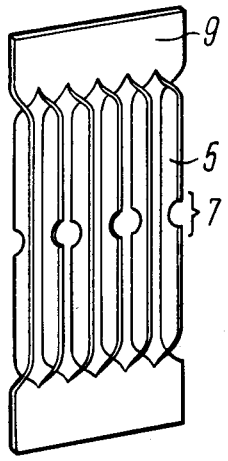
FIG. 7
FIG. 8
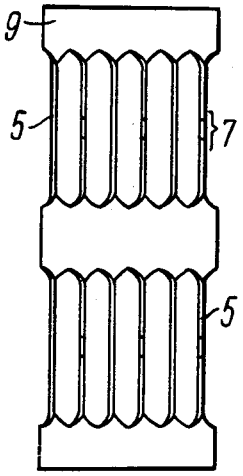
FIG. 9
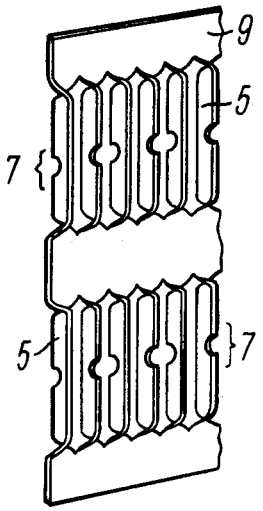

CIRCUIT PROTECTION FUSE

FIELD OF THE INVENTION

This invention relates to electrical apparatus and, more particularly, to circuit protection fuses suitable for use in switchgear assemblies and, also, for the protection of electrical installations and equipment.

DESCRIPTION OF THE PRIOR ART

Conventional fuses of high interrupting capacity meant for general use in industrial equipment have a casing filled with an arc-quenching material, terminal contacts fixed to the casing and a low-melting metal fuse link arranged within the casing and connected to the terminal contacts.

The arc-quenching material of such fuses is usually quartz sand, and the fuse link is most frequently made of copper or silver. Silver is, however, a scarce and expensive material, while copper does not ensure sufficient stability of the fuse operating characteristics in view of its low resistance to corrosion at high temperatures.

To solve these problems, fuse designers of many countries are widely engaged in the development of high-capacity fuses fitted with fuse links made of aluminium or aluminium alloys. Aluminium and its alloys are readily available and inexpensive materials of sufficiently high electric and heat conductivity. The dense and durable oxide film covering the surface of those materials protects them reliably from atmospheric corrosion.

Despite several favorable features of those materials, the development of fuses with aluminium fuse links requires the solution of a series of specific problems. One of the major problems, to be given priority in the search for a proper solution, is that of ensuring reliable interruption of fault currents by such fuses. The difficulty lies in the fact that the interruption of fault currents by fuses with aluminium fuse links gives rise to an exothermic reaction between the aluminium fusible elements and the quartz sand, a reaction accopanied by the liberation of a large quantity of heat that often drastically lessens the arc-quenching capacity of the quartz sand. As a result, the casing of the fuse bursts, and the ejected arc short-circuits the phases of the protected circuit.

The problem has not been solved as yet satisfactorily by a prior art fuse filled with quartz sand and employing a strip or cylindrical fuse link, wherein the strip width or cylinder diameter of the wide part of the fusible element is in a ratio of 10:1 to the width or diameter of the narrow part of the fusible element.

An analysis of various design versions of the above-mentioned fuse, both from the point of view of the reliability of current interruption and its field of application and simplicity of manufacture, reveals that the possibility of bursting of the fuse casing due to the effect of the exothermic reaction arising at interruption of fault currents has not been excluded, and that such fuses are of limited application in view of their low selectivity of operation. Moreover, the great difference between the cross-sectional area of the wide current-conducting part and the narrow fusible section of the fuse link, as well as the low mechanical strength of aluminium conductors in general, make the fuse links very flimsy and, consequently, they often break in the course of their installation within the fuse casing and on filling the latter with the arc-quenching material. It is practically impossible to detect any damage (say, a fracture) of the fuse link within an assembled fuse. Yet such a defect is liable to worsen the operating characteristics of the fuse to such an extent as to make it quite unfit for service.

Besides, the fuse links may become seriously damaged by the thermal stresses and mechanical loads arising in service, a factor that also deteriorates the operating characteristics of the fuse and renders it unfit for further use.

SUMMARY OF THE INVENTION

A primary object of the present invention is to provide a fuse of a high interrupting capacity.

Another object of this invention is to improve the stability of the time-current characteristic of operation of the fuse.

A further object of the invention is to increase the selectivity of circuit protection of the fuse.

Yet another object of this invention is to develop a rational design of the fuse link which would increase its mechanical strength.

This is accomplished by the development of a fuse for the protection of electric circuits comprising a casing filled with quartz sand, terminal contacts and a fuse link made of aluminium or its alloys. In accordance with the present invention, the ratio of the mass of the quartz sand filling the casing to the mass of the aluminium material of the fuse link within the quartz sand is at least 40:1.

It is of advantage to make the fuse link in the form of strip metal conductors separated from one another by the quartz sand with the widest current-conducting section of each strip having a width-to-thickness ratio within a range of 2:1 to 100:1.

It will be of further advantage for the fuse link to be made of at least one strip with current-conducting sections of maximum cross-sectional area and at least one fusible section of smaller cross-sectional area and to have the strip partially divided into bands bent away from the strip surface and the fusible sections of the strip arranged on the part of the strip that is divided into bands.

It is also preferable for the fuse link to be made of at least one strip with current-conducting sections of maximum cross-sectional area and at least one fusible section of smaller cross-sectional area and to have the strip partially divided into bands twisted about their longitudinal axis and the fusible section of the strip arranged on the part of the strip that is divided into bands.

It is also preferable for the fuse link to be made of at least one strip with current-conducting sections of maximum cross-sectional area and at least one fusible section of smaller cross-sectional area and to have the strip sections of full cross-sectional area partially divided into bands bent outwards from the surface of the strip, the number of such sections divided into bands being not less than $n+1$ and not greater than $5n-1$, where n is the number of undivided strip sections with the fusible part of the strip.

It is of no less advantage for the fuse link made of at least one strip with current-conducting sections of maximum cross-sectional area and at least one fusible section of smaller cross-sectional area to have the strip sections of maximum cross-sectional area partially divided into bands twisted about their longitudinal axis, the number of such sections divided into bands being not less than $n+1$ and not greater than $5n-1$, where n is the number of undivided strip sections containing the fusible part of the strip.

It is also advisable for the fuse link to be made of a strip partially divided into bands twisted about their longitudinal axis and to have the bands displaced aside in respect to the plane of the strip of the fuse link.

Further, it is of advantage for the fuse link to be made of at least one strip with current-conducting sections of maximum cross-sectional area and at least one fusible section of smaller cross-sectional area with the sections of maximum cross-sectional area being partially divided into bands bent outwards from the surface of the strip or twisted about their longitudinal axis and displaced aside to the plane of the strip, the number of such sections being not less than $n+1$ and not greater than $5n-1$, where n is the number of undivided strip sections containing fusible parts. This is done in order to provide the bands of the divided sections of the strip with additional fusible sections of small cross-sectional area.

It is also preferable for the fuse link to have at least two strip conductors made of aluminium or an aluminium alloy connected in series by an intermediate section of zinc or its alloy.

It is preferable for the fuse link to have at least one strip conductor made fully of aluminium or an aluminium alloy with a layer of low-melting zinc or a zinc alloy liquefier in the middle of the strip.

The herein proposed embodiment of the fuse ensures reliable extinction of the arc during use of comparatively thick aluminium conductors in the fuse link, prevents the bursting of the fuse casing by the exothermic reaction of the aluminium and quartz sand occuring during interruption of fault currents and makes the aluminium fuse link less susceptible to possible damage in manufacture and service.

Moreover, the proposed invention provides for an adequate selectivity of protection of the fuse.

From the foregoing it will be apparent that the proposed fuse with a fuse link of aluminium conductors ensures a high interrupting capacity, adequate selectivity of protection and stable time-current operating characteristics that are a characteristic feature of up-to-date fuses meant for general use in industrial equipment.

BRIEF DESCRIPTION OF THE DRAWINGS

The invention will be further described by way of example with reference to the accompanying drawings, in which:

FIG. 1 is an elevational view of the fuse with a part of its casing removed;

FIG. 2 is a front view of a fuse link made of a single band;

FIG. 3 is a front view of a fuse link made of a single strip;

FIG. 4 is a front view of a fuse link made of a strip partially divided into bands;

FIG. 5 is an axonometric projection of the fuse link depicted in FIG. 4;

FIG. 6 is a perspective view of a fuse link made of a strip with several sections divided into bands;

FIG. 7 is a perspective view of a fuse link made of a strip partially divided into bands twisted about their longitudinal axis;

FIG. 8 is a front view of the fuse link shown in FIG. 7 with several sections;

FIG. 9 is an axonometric projection of the fuse link depicted in FIG. 8;

FIG. 10 is a perspective view of a fuse link made of a strip with two sections partially divided into bands and one fusible section on the undivided part of the strip;

FIG. 13 is a front view of a fuse link made of a strip with two fusible sections on the undivided part of the strip;

FIG. 14 is an axonometric projection of the fuse link depicted in FIG. 13;

DETAILED DESCRIPTION OF THE INVENTION

Figure 11:
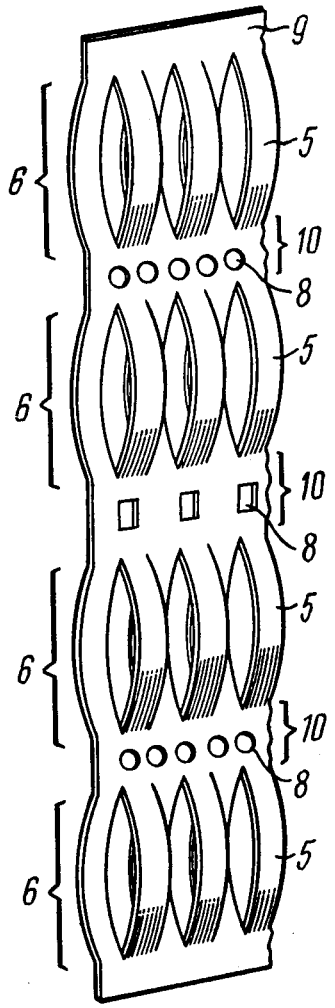
FIG. 11 is a perspective view of a fuse link similar to that of FIG. 10 with several fusible sections on the undivided parts of the strip.

The fuse comprises a casing 1 (FIG. 1) filled with quartz sand 2, terminal contacts 3 fixed to the casing 1 and a fuse link 4, made preferably of aluminium or an aluminium alloy, connected to the terminal contacts 3.

The ratio of the mass of the quartz sand 2 filling the casing 1 to the mass of the aluminium material of the fuse link 4 placed in the quartz sand 2 should be within the range of 40:1 to 200:1. With a smaller ratio of those masses, the fuse becomes incapable of ensuring reliable extinction of the arc throughout the range of interrupted fault currents. A higher ratio is of no advantage, as it does not improve the arc-quenching capacity of the fuse to any noticeable extent and only increases its overall dimensions.

The casing 1 of the herein proposed fuse may be made of any insulating material, for example, porcelain, kordierite, heat-resistant plastic, and may contain metal parts of, say, aluminium or its alloys.

It is preferable to make the terminal contacts 3 of aluminium so as to prevent electrochemical corrosion at the point of their connection to the aluminium fuse link 4.

To improve the surface conductivity of the contact parts of the terminal contacts 3, the latter may be coated with silver or any other suitable material.

The quartz sand 2 of the fuse should be sufficiently clean and consist of 0.1 to 1.2 mm dia. grains. The best results were obtained with 0.3 to 0.6 mm dia. grains.

For higher mechanical strength, better cooling and even distribution of the mass of aluminium within the quartz sand 2, it is preferable to divide the fuse link 4 into strips 5, the width-to-thickness ratio of the widest current-conducting section 6 of each strip being not less than 2:1 and not greater than 100:1.

Depending on the rated current, technological requirements and so forth, the fuse may be fitted with fuse links divided into bands 5 of various types. FIG. 2 shows the simplest embodiment for a low-rated fuse link made of a single band 5. The cross-sectional area of the band is selected according to its thickness, it being preferable for the width-to-thickness ratio of the widest current-conducting section 6 to be within the range of 2:1 to 100:1. In particular, it is recommended to make the band of a 0.3 to 0.7 $mm^2$ cross-sectional area and of a thickness of 0.1 to 0.3 mm. The limit values of the cross-sectional area of the widest current-conducting section 6 to the cross-sectional area of the fusible section 7 of considerably reduced cross-section are selected according to the required characteristics of circuit protection. To ensure a satisfactory combination of high interrupting capacity of the fuse and high mechanical strength of its bands, it is advisable to keep the cross-sectional ratio within the range of 2:1 to 6:1.

The fusible sections 7 of considerably reduced cross-sectional area can be obtained on the bands 5 by any conventional method, by flattening out the section 7 of the band, rolling the section 7, punching out a part of the band 5, etc. For clearer representation of the fusible section 7, the cross-section of the band shown by way of example in FIG. 2 was reduced by punching out a part of the metal. The cross-sectional area of the fusible sections of the bands 5 shown in FIG. 1 are reduced by drilling holes 8.

The length of the band 5 of the fuse link 4 and the number of fusible sections 7 are determined by the rated voltage of the fuse. In particular, the length of the band 5 can be selected for the given rated voltage of the fuse in compliance with the recommendations of the International Electrotechnical Commission (IEC) applying to the length of the fuse casings for respective voltages, and the number of fusible sections 7 to be provided on the band 5 is selected by the necessity of having 80 to 220 V of rated voltage per fusible section 7.

The fuse link 4 may be made up of several bands 5 connected in parallel at the terminal contacts 3 so as to form a fuse link 4 of a row of bands 5 (FIG. 1) or several rows of bands 5.

It is preferable to make the fuse link of fuses of medium and high current ratings of strips 9 (FIG. 3) having, in the same way as bands 5 (FIG. 2), current-conducting sections 6 (FIG. 3) of maximum cross-sectional area and at least one fusible section 7 of considerably smaller cross-sectional area. It is advisable to have the ratio of the cross-sectional area of the current-conducting sections 6 of strips 9 to the cross-sectional area of fusible sections 7, as well as of bands 5 (FIG. 2), within the range of 2:1 to 6:1.

It is of advantage to divide the strip 9 partially into bands 5 (FIG. 4) bend away from the surface of the strip so that the fusible sections 7 of the strip 9 are located on the part of the strip 9 divided into bands 5 (FIG. 5). In cases where there is not only one fusible section 7 on the strip 9, as shown in FIG. 3, but several fusible sections 7, as shown in FIG. 6, the strip may be divided into bands 5 bent outwards at several parts of the strip 9.

It is of advantage to have the fuse link made of a strip 9 (FIG. 7) divided partially into bands 5 containing the fusible sections 7 of the strip 9, said bands being twisted about their own longitudinal axis. In this case, as in the previous embodiment of the fuse link, the strip 9 may be divided into twisted bands on several of its parts, when the strip 9 has several fusible sections 7 rather than a single fusible section 7. The front view and axonometric projection of a strip 9 with two fusible sections 7 are presented in FIGS. 8 and 9, respectively.

Figure 12:
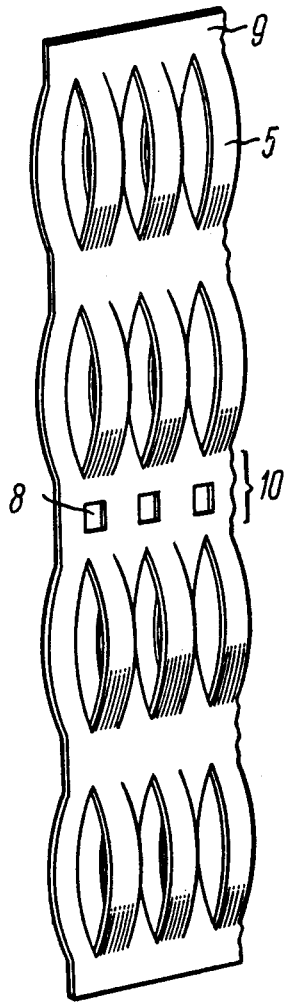
FIG. 12 is a perspective view of a fuse link made of a strip with several sections divided into bands and a single fusible section on the undivided part of the strip.

In manufacturing the fuse links of strips having a ratio of the cross-sectional area of the current-conducting sections 6 to the cross-sectional area of the fusible sections 7 less than 3.5:1, i.e., in the case of fuse links where the cross-sectional area of the fusible sections is weakened by holes 8, it is of advantage to divide the sections 6 of maximum cross-sectional area of the strip 9 partially into bands 5 bent outwards from the surface of the strip 9, the number of such sections of the strip 9 divided into bands 5 being not less than $n+1$ (FIGS. 10, 11) and not greater than $5n-1$ (FIG. 12), where n is the number of undivided strip sections 10 containing the fusible parts of the strip 9. Such an embodiment of the fuse link with a greatly weakened cross-sectional area of the fusible sections gives the fuse link a rational shape and makes it of adequate mechanical strength.

A similar result is obtained in fuse links made of strips with a similar number of sections 10 as in the previous embodiment (i.e, not less than $n+1$ and not greater than $5n-1$) by twisting the bands 5 of the strip 9 about their longitudinal axis. The front view and axonometric projection of such a fuse link are presented in FIGS. 13 and 14, respectively. In this embodiment, the section 10 of the strip 9, undivided into bands 5, has several fusible sections made up of two rows of holes 8.

Figure 15:
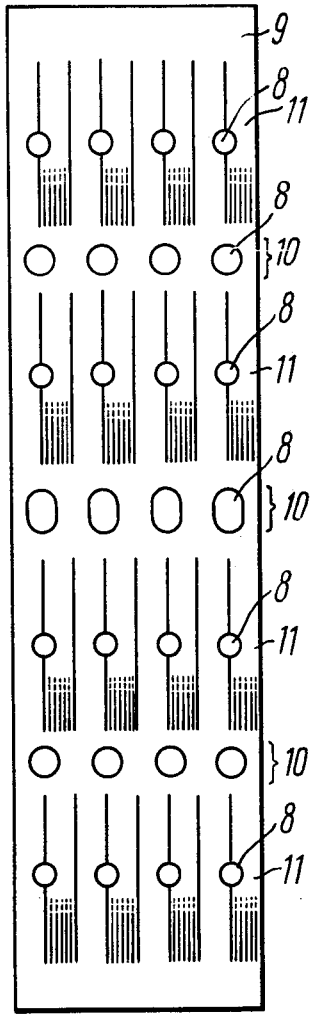
FIG. 15 is a front view of a fuse link made of a strip with the fusible sections on the undivided and divided sections of the strip.
Figure 16:
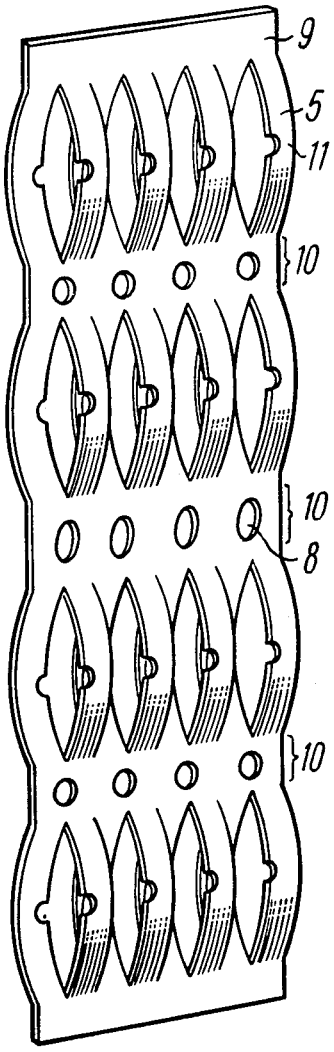
FIG. 16 is an axonometric projection of the fuse link depicted in FIG. 15.

In the two foregoing embodiments of the fuse link depicted in FIGS. 10, 11, 12 and FIGS. 13, 14, the sections of the strip 9 divided into bands 5 may be provided with additional fusible sections when this becomes necessary or the fuse link does not have to meet stringent requirements as regards its mechanical strength. Such an embodiment of the fuse link is illustrated in FIG. 15 (front view) and FIG. 16 (axonometric projection). The additional fusible sections 11 are obtained by punching out a part of the bands 5.

Figure 17:
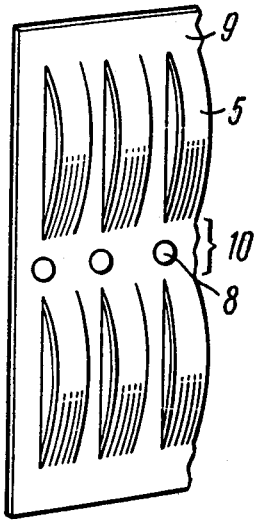
FIG. 17 is a perspective view of a fuse link made of a strip with sections divided into bands bent away from the surface of the strip.
Figure 18:
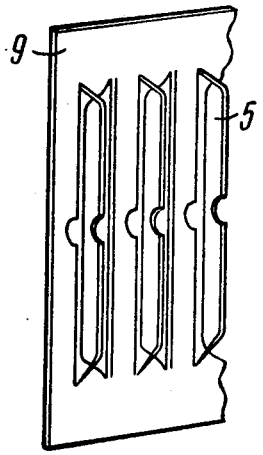
FIG. 18 is a perspective view of a fuse link made of a strip with sections divided into bands twisted about their longitudinal axis.

The above-described embodiments of fuse links made of strips 9 may have sections divided into bands, wherein only some of the bands 5 (for instance, every second one) is bent outwards from the surface of the strip 9 (FIG. 17) or only some of the bands 5 are twisted about their axis (FIG. 18).

Figure 19:
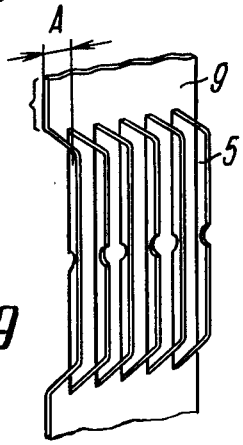
FIG. 19 is a perspective view of a fuse link made of a strip with sections divided into bands twisted about their longitudinal axis and displaced aside from the plane of the strip.

FIG. 19 shows an embodiment of a fuse link made of a strip 9 differing from the embodiments depicted in FIGS. 7, 8, 9, 12, 13 in that the bent bands 5 are displaced to one side, in particular, to one side with respect to the plane of the strip 9 by a distance A.

Figure 20:
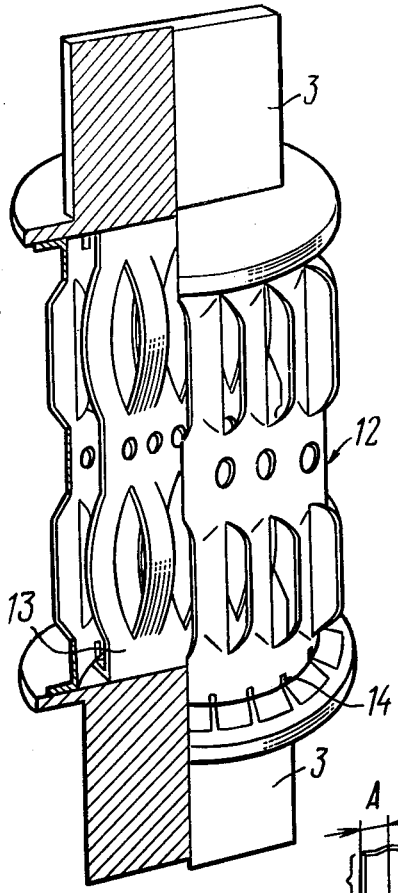
FIG. 20 illustrates connection of the fuse links to the terminal contacts of the fuse.

For more rational arrangement of the fuse links within the casing of fuses rated for heavy currents, the fuse links made of strips may be interconnected electrically across the terminal contacts 3 and installed as shown in FIG. 20.

FIG. 20 shows that one of the fuse links 12 is rolled into a cylinder and the second fuse link 13 is placed inside the fuse link 12. Further, various modifications of the arrangement of the fuse links 12 and 13 within the casing of the fuse may be effected without departure from the scope of the invention as defined in the appended claims.

The fuse link 12 is provided with slots 14 at the point of its connection to the terminal contacts 3 in order to ensure better filling of the recesses near the terminal contacts with the quartz sand. The fuse link 13 may be provided with similar slots.

To raise the inertia and lower the operating temperature of the fuse in handling overload currents above the limit value of the melting current, it is advantageous to make the fuse link of at least two conductors 15 (FIG. 21) of aluminium or aluminium alloy connected in series by an intermediate section 16 made of zinc or a suitable zinc alloy. It should be emphasized that the intermediate section 16 is to be made of zinc or a zinc alloy since joints of aluminium and zinc or its alloys are of high mechanical strength and highly resistant to electrochemical atmospheric corrosion. These properties of such joints ensure an adequate mechanical strength of the fuse link.

It should also be noted that in making the intermediate section 16 of zinc alloy, it is desirable for its melting point to be no higher than 500° C., and for the zinc content to be not less than 15 per cent of the mass of the alloy. Aluminium, magnesium, copper, cadmium, tin and other low-melting metals may be used in the alloy.

All the above-described embodiments of the fuse link may be provided with an intermediate section 16 made of zinc or its alloys.

Let us consider a few examples of such an embodiment of the fuse link.

Figure 21:
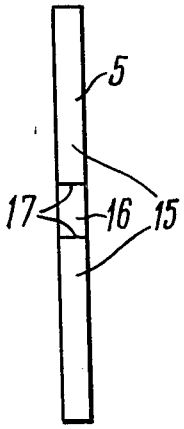
FIG. 21 is a front view of a fuse link made of two conductors connected in series by an intermediate zinc section.

FIG. 21 illustrates the simplest case of a fuse link made of a single strip 9 containing an intermediate section 16. The joint 17 of the aluminium conductors 15 and the intermediate section 16 is the fusible section of the fuse link.

The cross-sectional area of the intermediate section 16 is selected according to the required inertia of the time-current characteristic of the fuse.

The larger the cross-sectional area of the intermediate section 16, the higher the inertia of the time-current characteristic of the fuse link.

Figure 22:
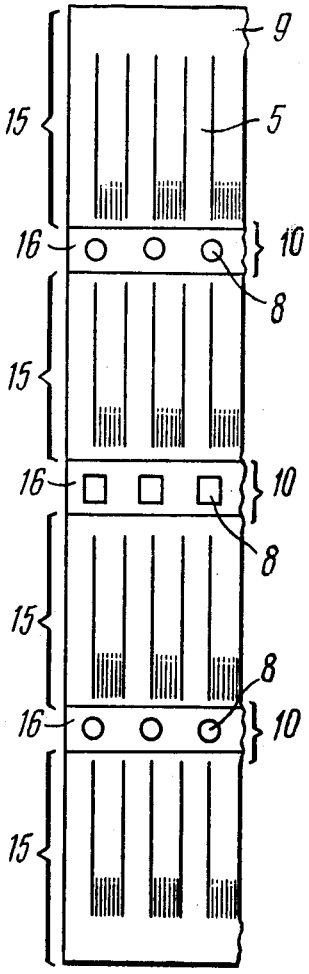
FIG. 22 is a front view of a fuse link made of a strip divided into several conductors connected in series by intermediate zinc sections.
Figure 23:
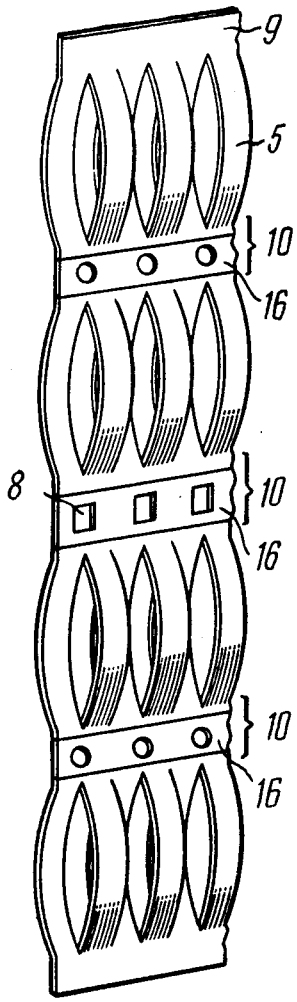
FIG. 23 is an axonometric projection of the fuse link depicted in FIG. 22.

FIGS. 22, 23 show a fuse link made of a strip 9, wherein the current-conducting sections of maximum cross-sectional area made of aluminium conductors 15 are partially divided into bands 5 bent outwards from the surface of the strip 9. The fusible sections of the strip 9 of this embodiment of the fuse link are located on the intermediate section 16, the cross-sectional area of which is reduced by punching a row of holes 8 in that section.

Figure 24:
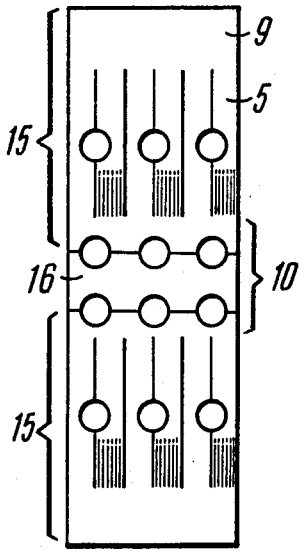
FIG. 24 is a front view of a fuse link made of a strip with an intermediate zinc section and an undivided part with two fusible sections.
Figure 25:
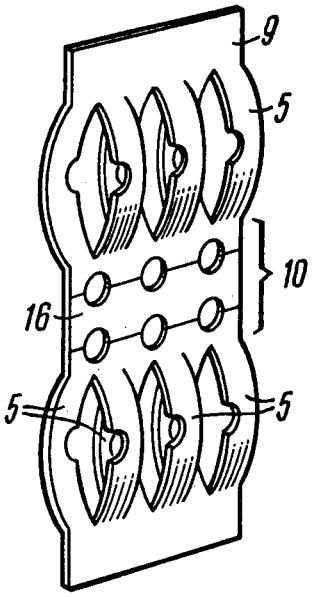
FIG. 25 is an axonometric projection of the fuse link depicted in FIG. 24.

FIGS. 24, 25 show an embodiment of a fuse link made of a strip 9 differing from that depicted in FIGS. 22, 23 in that the fusible sections of smaller cross-sectional area are not only the intermediate sections 16, but also aluminium conductors 15 in the form of bands 5 bent outwards from the surface of the strip 9.

A result similar to that described above for the case of a fuse link comprising several aluminium conductors 15 connected in series by an intermediate section 16 can be obtained by fuse links having at least one conductor 15 of aluminium or aluminium alloy with a layer of a low-melting liquiefier (zinc or its alloy) in the middle part 17 of the conductor.

The inconsiderable spread of the molten zinc over the aluminium surface and its ability of rapidly fusing with the aluminium at a slight temperature rise of the melt (440 to 460° C.) above the melting point of zinc (420° C.) and forming a liquid-metallic solution of high electrical resistance gives such a fuse a sufficiently accurate time-current characteristic of operation within the range of overload currents. At the same time, the comparatively low melting points of aluminium and zinc and their high resistance to corrosion ensure low power losses within the fuse and long service life under rated duty conditions.

The above-described fuse links with aluminium conductors carrying a layer of zinc on their middle part 17 can be employed in all the previous embodiments of the herein proposed fuse link.

Figure 26:
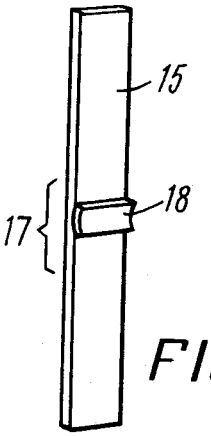
FIG. 26 is a perspective view of a fuse link made of a single aluminium strip conductor with a layer of a liquefier in the middle of the strip.

FIG. 26 illustrates an embodiment of the fuse link with a layer 18 of a zinc liquefier.

The layer 18 of zinc liquefier is applied to the middle part (also referred to as the overload section) of the conductor 15.

As may be seen from FIG. 26, the layer 18 is of a specific thickness selected according to the required inertia of the time-current characteristic of the fuse link.

Figure 27:
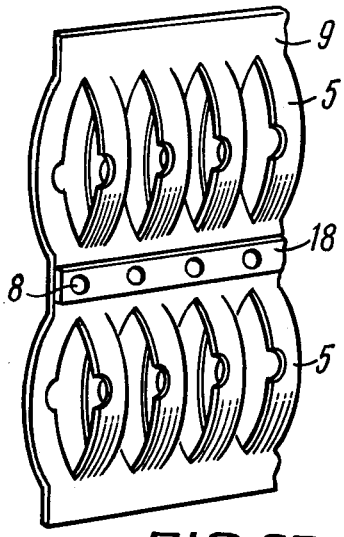
FIG. 27 is a perspective view of a fuse link made of a strip partially divided into bands and with a section covered with a layer of liquiefier.
Figure 28:
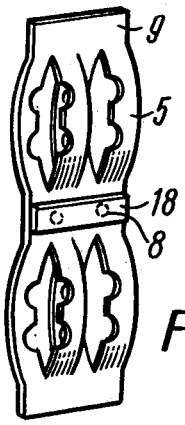
FIG. 28 is a perspective view of a fuse link made of a strip partially divided into bands and with a section covered with a layer of liquefier having holes therein.

The thicker the layer 18, the higher the inertia of the time-current characteristic of operation of the fuse link. The time-current characteristic of operation of the fuse link within the range of overload currents can be varied by reducing the cross-sectional area of the fuse link at the point of location of the layer 18 (FIG. 27). This can be achieved, for instance, by drilling a row of holes in the middle part 17 of the conductor 15 and then applying the layer 18 to that part (FIG. 28).

The time-current characteristic of operation of the fuse link can also be varied by changing the composition of the zinc layer 18 and using various alloys of zinc and aluminium, magnesium, copper, cadmium, tin and other low-melting metals. It is desirable for the melting point of the alloy employed to be no higher than 500° C., and for the content of zinc to be not less than 15 percent of the mass of the alloy.

To lessen the ageing of the fuse links (deterioration of characteristics in service), the dimensions of the layer 18 along the path of current flow should not exceed 15 percent of the length of the fuse link in the same direction.

The layer 18 may be applied to the surface of the fuse link by any conventional method.

In particular, this can be accomplished by soldering the zinc mass to the surface of the fuse link and, also, by resistance welding. The latter method is preferable.

Figure 29:
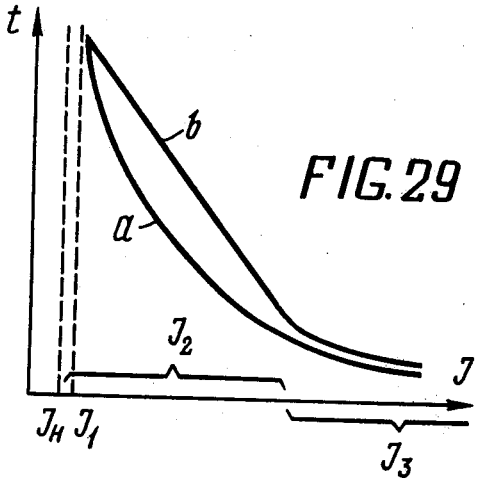
FIG. 29 is a graph of the time-current characteristics of the fuse.

FIG. 29 presents examples of the time-current characteristics of operation of the fuses of the herein proposed design for the same limit current $I_1$ employing various types of fuse links. Curves (a) and (b) of the drawing represent the dependence of the melting time t of the fuses on the magnitude of the current flowing through the fuse. Curve (a) applies to fuse links made solely of aluminium or its alloy, and curve (b) applies to fuse links containing either a zinc intermediate section 16 or a layer 18 of zinc liquefier. $I_2$ is the range of overload currents, $I_3$ represents the range of short-circuit currents, and $I_n$ is the rated fuse current.

The above-described fuse for the protection of electric circuits offers the following advantages.

The fuse works as an ordinary conductor for rated current and permissible overloads of short duration. The high resistance to corrosion and sufficiently high electric and heat conductivity of the material of the fuse link ensure a long service life, low temperature rise and small power losses of the herein proposed fuse.

The fuse link melts during passage of inadmissible currents and the resulting arc is quenched reliably inside the fuse by the quartz sand. The possibility of bursting of the fuse casing and consequent short-circuiting of the circuit phases, due to the exothermic reaction between the aluminium fuse link and the quartz sand, is fully prevented in the proposed fuse by a sufficiently even distribution of the mass of aluminium within the quartz sand and the optimum ratio of the mass of the quartz sand to the mass of the aluminium material of the fuse link at which the quartz sand, despite the exothermic reaction of the aluminium, remains utmostly capable of intensively absorbing and diffusing the energy released within the fuse and remains an efficient arc-quenching medium.

When using aluminium fuse elements with an intermediate section 16 or layer 18, the long-term (inadmissible) overload currents and released heat first melt the zinc intermediate section 16 or layer 18 of lower melting point, the latter rapidly fuse with the aluminium of the fuse link and form a liquid-metallic bridge of aluminium-zinc alloy in the middle part of the fuse link.

Having a high electrical resistance (of an order higher than the resistance of the same section prior to the establishment of the liquid-metallic bridge), the bridge is rapidly disintegrated by the current and breaks the electric circuit. During that process, the inertia of the time-current characteristic of the fuse link increases substantially (FIG. 28, curve (b)) by the considerably greater mass of the zinc fusible sections that need a considerably greater amount for their melting than the similar fusible section of aluminium.

The high stability of the time-current characteristic of operation of such fuse links is ensured by the ability of the zinc melt to fuse rapidly with the aluminium even at a moderate overheating (20° to 30° C. above the melting point of zinc).

The high stability of all the mentioned characteristics of operation of the entire fuse made in accordance with the herein proposed invention is ensured by the employment of relatively thick aluminium conductors highly resistant to mechanical damage in the process of manufacture and service of the fuse. This, in turn, has been achieved by ensuring a maximum efficiency of arc-quenching by the quartz sand, thus eliminating the possibility of the fuse casing being burst by the exothermic reaction occuring within the fuse.

Tests have proved that such fuses used in 660 V circuits are capable of reliably interrupting a current of about 100 $kA_{rms}$ and withstand without any change in their operating characteristics impacts not less than 15 g.

This data is not the upper limit of performance of the herein proposed fuse and is only the limit imposed by the testing equipment employed.

Tests have also revealed that the herein described fuse has a high selectivity of circuit protection. In particular, the ratio of $\int I^2dt$ of full operation to the same integral of melting may be at a value of about three.

The high service reliability of the herein proposed fuse with aluminium fuse links offers wide opportunities of use of such fuses in industrial installations and equipment, thus enabling the saving of tons of expensive and scarce silver and a considerable economic gain.

What is claimed is:

1. A fuse for protection of electric circuits, comprising a casing filled with quartz sand; terminal contacts; and a fuse link of aluminum or an aluminum alloy connected to said terminal contacts, the ratio of the mass of the quartz sand to the mass of the fuse link being in the range 40:1 to 200:1, said fuse link being made of at least one strip, each strip including at least two current-conducting sections and at least one fusible section, said current-conducting sections having a greater cross section than said fusible sections, said current-conducting sections having a width to thickness ratio in the range of 2:1 to 100:1.

2. A fuse for protection of electric circuits according to claim 1, wherein each of said strips is divided into a row of bands bent away from a surface of said strip and said fusible sections are located on said bands.

3. A fuse for protection of electric circuits according to claim 2, wherein there are a plurality of rows of said bands.

4. A fuse for protection of electric circuits according to claim 1, wherein each of said strips is divided into a row of bands twisted about their own longitudinal axis and said fusible sections are located on said bands.

5. A fuse for protection of electric circuits according to claim 4, wherein there are a plurality of rows of said bands.

6. A fuse for protection of electric circuits according to claim 1, wherein said current-conducting sections are divided into bands bent outward from a surface of said strip, the number of current-conducting sections being at least $n+1$ and no more than $5n-1$, where n is the number of fusible sections.

7. A fuse for protection of electric circuits according to claim 1, wherein said current-conducting sections are divided into bands twisted about their own longitudinal axis, the number of current-conducting sections being at least $n+1$ and no more than $5n-1$, where n is the number of fusible sections.

8. A fuse for protection of electric circuits according to claim 6, wherein additional fusible sections are located on said bands.

9. A fuse for protection of electric circuits according to claim 7, wherein additional fusible sections are located on said bands.

10. A fuse for protection of electric circuits, according to claim 1, wherein each of said strips is divided into a row of bands, alternate bands being bent away from a surface of said strip, said fusible sections being located on said bands.

11. A fuse for protection of electric circuits, according to claim 10, wherein there are a plurality of rows of said bands.

12. A fuse for protection of electric circuits, according to claim 1, wherein each of said strips is divided into a row of bands, alternate bands being twisted about their own longitudinal axis, said fusible sections being located on said bands.

13. A fuse for protection of electric circuits according to claim 12, wherein there are a plurality of rows of said bands.

14. A fuse for protection of electric circuits according to claim 1, wherein said current-conducting sections are divided into bands, alternate bands being bent outward from a surface of said strip, the number of current-conducting sections being at least $n+1$ and no more than $5n-1$, where n is the number of fusible sections.

15. A fuse for protection of electric circuits according to claim 1, wherein said current-conducting sections are divided into bands, alternate bands being twisted about their own longitudinal axis, the number of current-conducting sections being at least $n+1$ and no more than $5n-1$, where n is the number of fusible sections.

16. A fuse for protection of electric circuits according to claim 14, wherein additional fusible sections are located on said bands.

17. A fuse for protection of electric circuits according to claim 15, wherein additional fusible sections are located on said bands.

18. A fuse for protection of electric circuits according to claim 4, wherein said bands are offset with respect to the plane of said strip.

19. A fuse for protection of electric circuits according to claim 5, wherein said bands are offset with respect to the plane of said strip.

20. A fuse for protection of electric circuits according to claim 7, wherein said bands are offset with respect to the plane of said strip.

21. A fuse for protection of electric circuits according to claim 9, wherein said bands are offset with respect to the plane of said strip.

22. A fuse for protection of electric circuits according to claim 1, wherein said current-conducting sections are made of aluminum or an aluminum alloy and said fusible section is made of zinc or a zinc alloy.

23. A fuse for protection of electric circuits according to claim 1, wherein said current-conducting sections are made of aluminum or an aluminum alloy and said fusible section is a layer of a low-melting liquefier of zinc or a zinc alloy.

* * * * *